US007946576B2

(12) United States Patent
Deaville et al.

(10) Patent No.: US 7,946,576 B2
(45) Date of Patent: May 24, 2011

(54) DOCUMENT STACKER WITH FAULT DETECTION

(75) Inventors: David C. Deaville, West Chester, PA (US); Bob Mackenzie, West Chester, PA (US); Carl A. Phillips, West Chester, PA (US); Kenneth B. Wood, Downingtown, PA (US)

(73) Assignee: MEI, Inc., West Chester, PA (US)

( * ) Notice: Subject to any disclaimer, the term of this patent is extended or adjusted under 35 U.S.C. 154(b) by 42 days.

(21) Appl. No.: 12/027,695

(22) Filed: Feb. 7, 2008

(65) Prior Publication Data

US 2008/0128241 A1 Jun. 5, 2008

Related U.S. Application Data

(62) Division of application No. 10/784,733, filed on Feb. 23, 2004, now abandoned.

(51) Int. Cl.
*B65H 43/00* (2006.01)

(52) U.S. Cl. ..... 271/176; 271/177; 271/180; 194/206; 318/434; 388/903; 361/23

(58) Field of Classification Search ..... 271/181, 271/180, 177, 176; 194/206, 207; 209/534; 318/434; 388/903; 361/23–34
See application file for complete search history.

(56) References Cited

U.S. PATENT DOCUMENTS

| | | | | |
|---|---|---|---|---|
| 4,678,072 | A | 7/1987 | Kobayashi et al. | |
| 4,765,607 | A | 8/1988 | Zouzoulas | |
| 5,209,335 | A | 5/1993 | Shuren et al. | |
| 5,282,611 | A * | 2/1994 | Ueda et al. | 271/270 |
| 5,709,293 | A | 1/1998 | Ishida et al. | |
| 5,709,525 | A | 1/1998 | Marzullo et al. | |
| 5,756,985 | A * | 5/1998 | Holste et al. | 235/475 |
| 5,782,469 | A | 7/1998 | Schoon et al. | |
| 5,836,577 | A | 11/1998 | Arikawa et al. | |
| 5,982,126 | A | 11/1999 | Hellinga et al. | |
| 6,076,648 | A | 6/2000 | Hatamachi et al. | |
| 6,199,856 | B1 * | 3/2001 | Clauser et al. | 271/180 |
| 6,398,000 | B1 | 6/2002 | Jenrick et al. | |
| 6,495,981 | B2 | 12/2002 | Romanowich et al. | |
| 6,598,871 | B2 | 7/2003 | Ono et al. | |
| 6,827,347 | B2 | 12/2004 | Ito et al. | |
| 2004/0207151 | A1 * | 10/2004 | Beskitt et al. | 271/264 |

FOREIGN PATENT DOCUMENTS

| | | |
|---|---|---|
| DE | 2 321 654 | 11/1974 |
| EP | 0 720 132 B1 | 7/1996 |
| JP | 11-116098 | 4/1999 |
| WO | WO 02/066350 A1 | 8/2002 |
| WO | WO 02/083537 A1 | 10/2002 |

* cited by examiner

*Primary Examiner* — Stefanos Karmis
*Assistant Examiner* — Gerald W McClain
(74) *Attorney, Agent, or Firm* — Fish & Richardson P.C.

(57) ABSTRACT

Techniques include sensing electric signals from an actuator during a document stacking operation and determining whether an abnormal event has occurred based on the sensed signals. The techniques may find particular applicability, for example, to document acceptors that include piston-type stackers driven by a direct current motor.

15 Claims, 7 Drawing Sheets

DOCUMENT STACKER WITH FAULT DETECTION

CROSS-REFERENCE TO RELATED APPLICATIONS

This application is a divisional of U.S. Ser. No. 10/784,733, filed on Feb. 23, 2004.

BACKGROUND

Document acceptor assemblies, such as those used in the vending and gaming industries, typically store accepted banknotes or other documents in a cassette. A stacking mechanism may be incorporated in the assembly to facilitate storage of the documents in the cassette.

Various types of stackers are known, including piston-type stackers. It is generally desirable for the system to obtain confirmation that an accepted document has been stored properly in the cassette. One way to accomplish that is to verify the piston has completed its full stroke cycle and has returned to its home position. A linear or rotary encoder may be provided for that purpose. Unfortunately, the addition of such components may add substantially to the cost of the document stacker.

Another technique relies only on signals from the home sensor to determine whether the piston has completed its full stroke cycle. Although systems incorporating that technique may be simpler and less costly, they are unable to differentiate between different situations that may cause stalling of the stacker. For example, the stacker may stall either because the cassette is full or because the stacker mechanism is jammed. Preferably, an automated system should handle those situations differently because the former situation is the result of normal operation, whereas the latter situation should be detected as a fault.

More generally, it would be helpful to be able to detect various abnormal events during operation of a document stacker and to distinguish those events from expected, normal events.

SUMMARY

The invention relates to techniques that may be used in connection with a document stacker. The techniques may facilitate the determination of whether an abnormal event has occurred during a stacking operation.

In one aspect, a method includes sensing electric signals from the actuator during a document stacking operation and determining whether an abnormal event has occurred based on the sensed signals.

In another aspect, an apparatus includes a document stacker that has a cassette to store documents, a piston to push a document into the cassette, an actuator to control movement of the piston, and first circuitry to sense electric signals from the actuator. Additional circuitry is coupled to the actuator to control its operation. The additional circuitry also is coupled to the first circuitry to obtain signals indicative of how the actuator is functioning during a document stacking operation. The additional circuitry is adapted to determine whether an abnormal event has occurred based on the signals indicative of how the actuator is functioning.

In various implementations, one or more of the following features may be present. For example, determining whether an abnormal event has occurred may include comparing one or more values derived from the sensed values to at least one reference value. The sensed values may be indicative of the actuator load (e.g., current). In some cases, the reference value may be adjusted based on previously sensed values of actuator load.

Determining whether an abnormal event has occurred may include comparing an amount of time that has elapsed between specified sensed values of actuator load to a predetermined amount of time. In some implementations, an amount of time that has elapsed from a specified point in the stacking operation to a peak value of actuator load may be identified. Determining whether an abnormal event has occurred then may be based on the identified amount of time. In other implementations, an amount of time that has elapsed from a specified point in the stacking operation to a predetermined threshold value of actuator load may be identified. Determining whether an abnormal event has occurred then may be based on the identified amount of time.

In some implementations, determining whether an abnormal event has occurred may include comparing an actual profile of the actuator load with an expected profile. Alternatively, the actuator load may be integrated for a specified period of time during a document stacking operation to obtain an integrated value. Determining whether an abnormal event has occurred may be based on the integrated value.

Determining whether an abnormal event has occurred may be based on combinations of the foregoing techniques.

The techniques may be particularly advantageous, for example, in determining whether a document cassette is full or the stacker is jammed.

When the techniques are incorporated into a document acceptor, the techniques may include receiving a document in the document acceptor, determining whether the document is considered to be valid, transporting the document from the acceptor to the stacker, and storing the document in the cassette.

Other features and advantages will be readily apparent from the following detailed description, the accompanying drawings and the claims.

DETAILED DESCRIPTION

Figure 1:
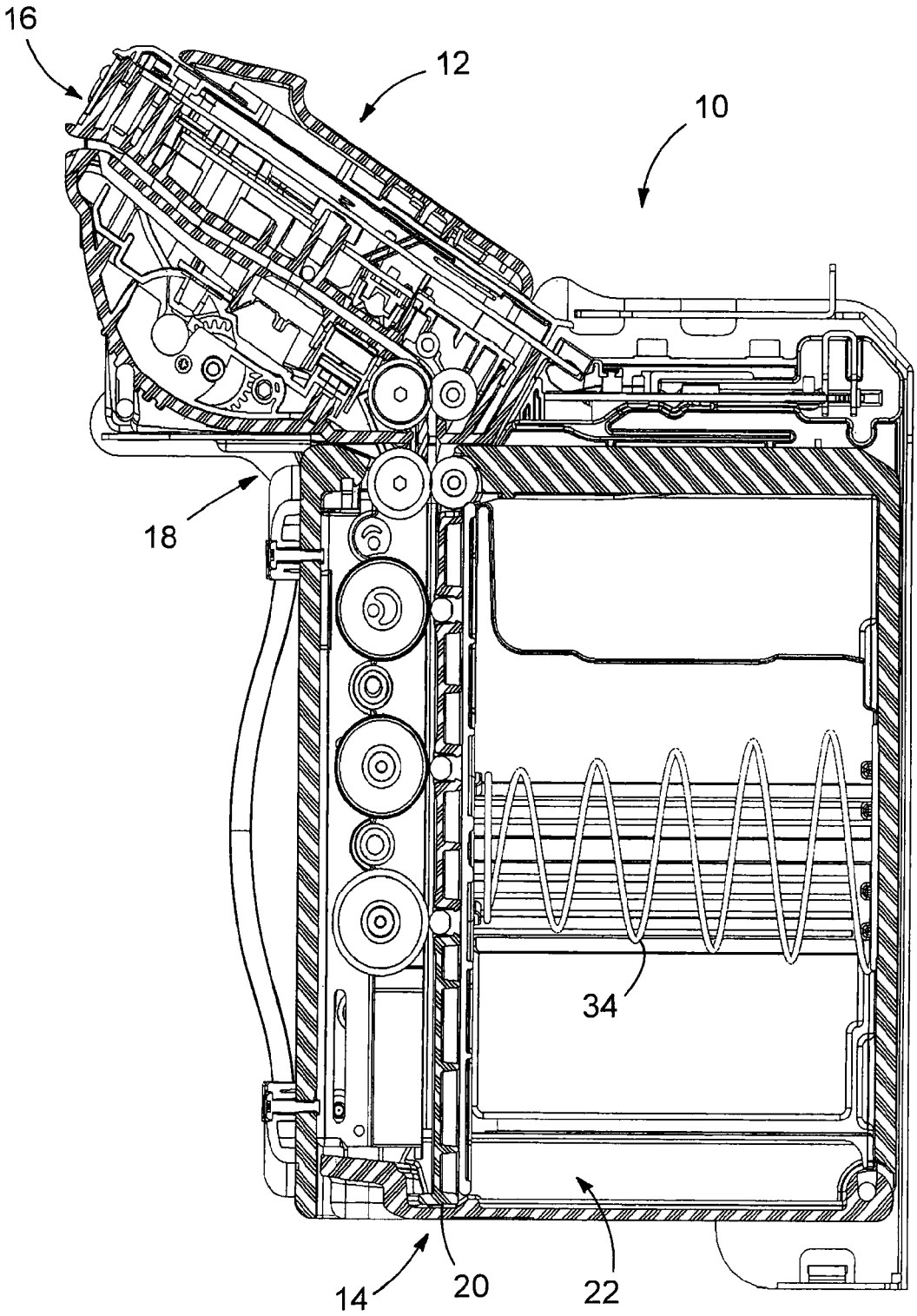
FIG. 1 illustrates an example of document acceptor that incorporates a document stacker according to the invention.

FIG. 1 illustrates an example of an implementation of a currency acceptor assembly 10 that includes a currency validator 12 connected to a piston-type currency stacker 14.

The validator 12 determines whether inserted currency documents are acceptable. As used herein, currency documents may include, but are not limited to, banknotes, bills, security documents, paper currency and the like that may be used as legal tender in exchange for goods or service, and that may be inserted into a currency acceptor for validation and storage in return for goods or services.

Banknotes may be inserted one at a time into the validator 12 at entrance 16. From the entrance 16, the banknote 38 is transported through the validator 12 to the validator's banknote output by pairs of pulleys or rollers and belts that grip the side edges of the banknote and that may be driven by a motor and drive train according to known techniques.

As the banknote is transported through the validator 12, the banknote may be tested by a group of sensors to ascertain its validity and denomination. Output signals from the sensors may be processed by logic circuits in the validator 12 to determine whether the banknote is acceptable. Any of various known techniques using optical, magnetic, inductive or other types of sensors may be used to test the banknote. A banknote which is unacceptable may be ejected back out through the entrance 16.

An acceptable banknote is transported into an interconnection region 18 in which the validator 12 and stacker 14 are connected together. The interconnection region 18 establishes a smooth uninterrupted path for a banknote to follow when leaving the validator 12 and entering the stacker 14. The accepted banknote is transported from the stacker's entrance into a pre-storage channel 20. In a fashion somewhat analogous to the way that a picture frame holds a picture, the channel 20 "frames" the banknote at its side edges and holds it stiff prior to stacking. The piston-type stacker 14, described in greater detail below, pushes the accepted banknote into a cassette 22 where it is stored until removed by service personnel. The cassette is designed to be readily removed or opened by service personnel so that stacked banknotes can be removed.

Figure 2:
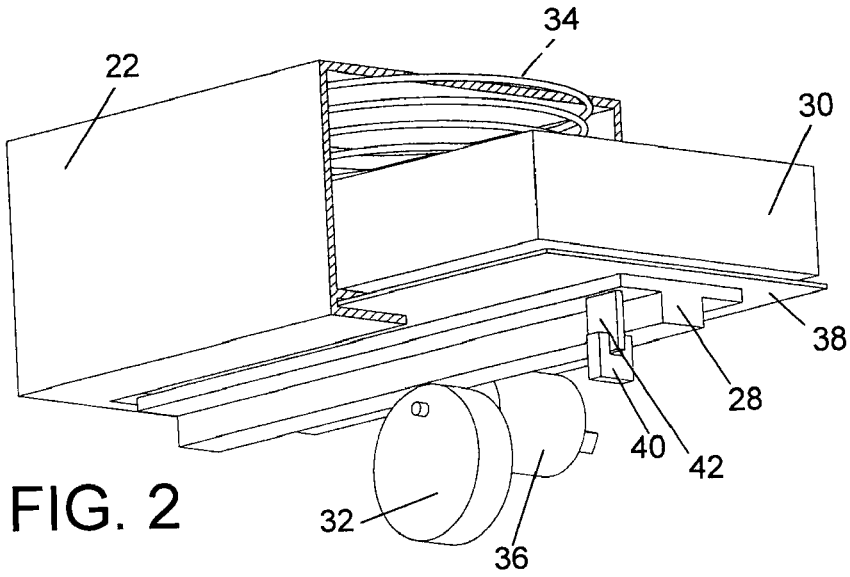
FIG. 2 is an isometric partial section view of a document stacker.
Figure 3:
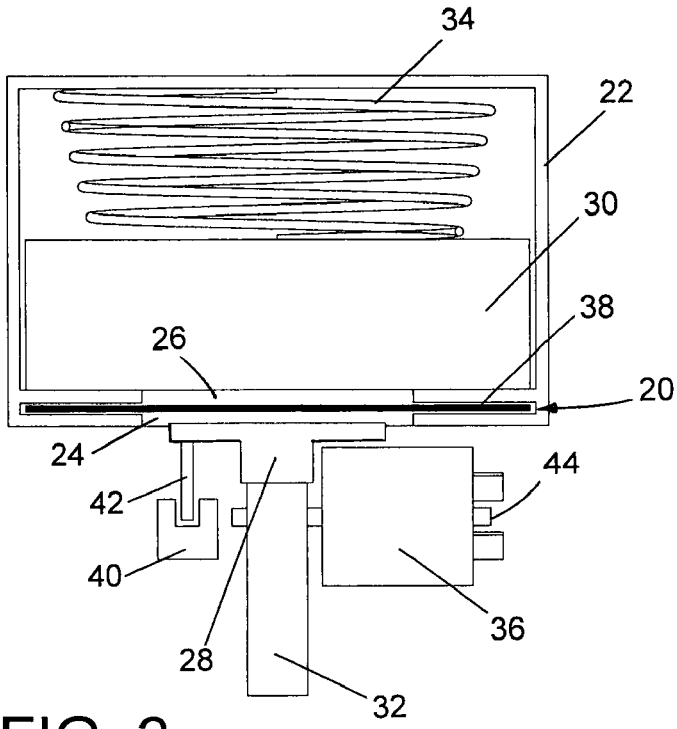
FIG. 3 is an end view of the document stacker of FIG. 2 with a piston in the home position.

As shown in FIGS. 2 and 3, the stacker 14 includes two apertures 24, 26 that permit a piston 28 to freely pass. The aperture 24 should be sufficiently small that stacked banknotes or other documents 30 cannot pass through the aperture without some bending. The piston 28 may be in direct contact with a cam 32 that is coupled to an electric motor 36 or other actuator. For example, a permanent magnet direct current (DC) motor may be used. A conical spring 34 provides a clamping force that ensures that the banknote 38 to be stacked does not slide across the document stack 30. The spring 34 also keeps the documents in the stack 30 closely packed and stable.

An optical switch 40 is provided for detecting the presence of a flag 42 that indicates when the piston 28 is in the home position (i.e., when the piston is not obstructing the pre-storage document channel 20). The flag 42 may be formed, for example, as a protrusion from the backside of the piston 28.

Figure 11:
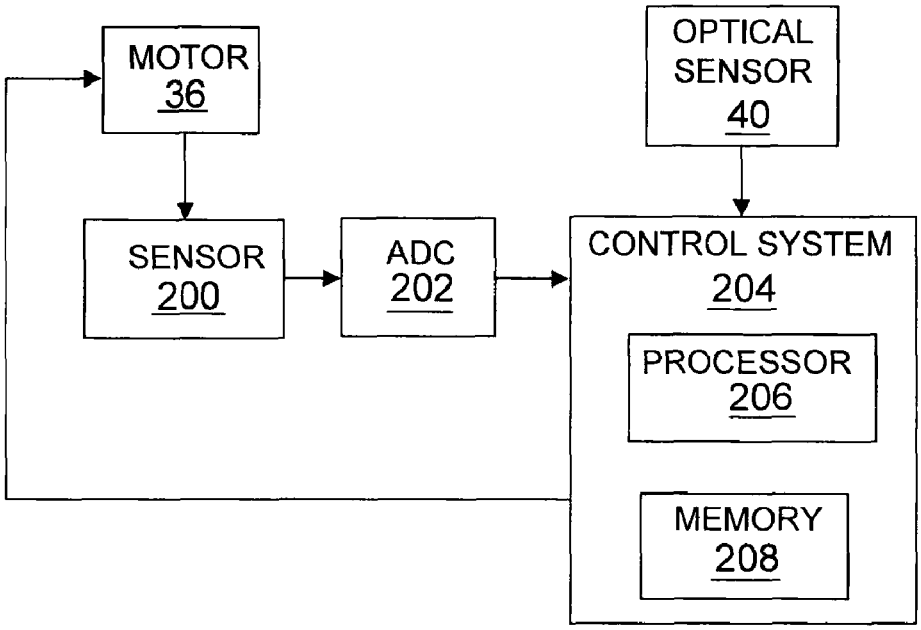
FIG. 11 is a block diagram illustrating a controller for the stacker.

A sensor is provided to sense electrical signals from the motor during a document stacking operation. In a particular implementation, as shown in FIG. 11, a motor current sensor 200 is coupled to the motor 36 and allows the motor current to be measured. The sensor 200 may include, for example, a series resistor coupled between the motor 36 and an analog-to-digital converter (ADC) 202. Output signals from the ADC 202 are provided to a control system 204.

The control system 204 may include a microprocessor 206 to control when the motor 36 is turned on or off in response to signals from the optical sensor 40 and the motor current sensor 200. As discussed below, the microprocessor 206 also can measure the passage of time using, for example, an interrupt software routine driven by a clock signal.

FIGS. 3 through 7 illustrate the sequence of operation for stacking a document according to one implementation. For the purposes of illustration, it may be assumed that the cassette 22 is empty or nearly empty. FIG. 3 illustrates the stacker mechanism in the home position, corresponding to FIG. 2. In that position, the piston 28 is fully retracted, and the flag 42 blocks the optical switch 40. A document 38 is in the pre-storage channel 20 ready to be stacked in the cassette 22.

Figure 4:
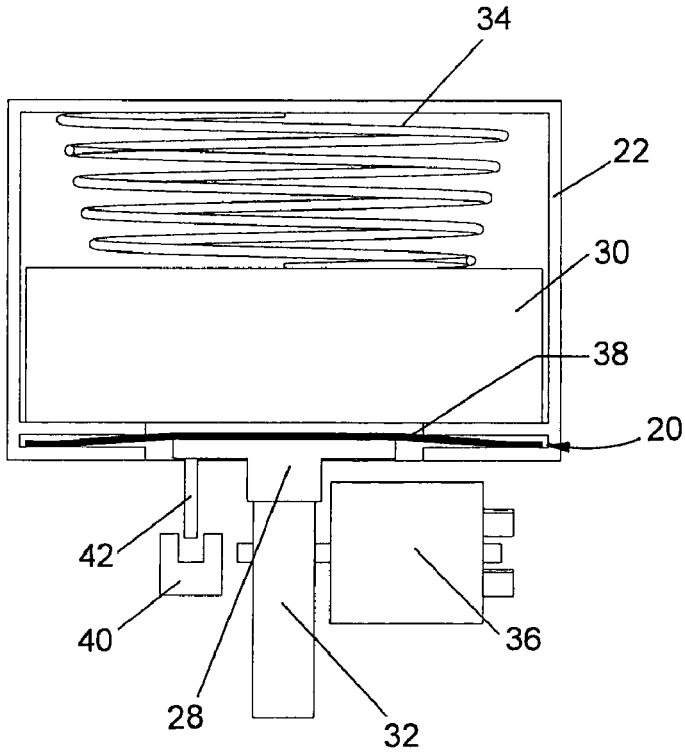
FIGS. 4-7 are end views of the document stacker of FIG. 2 illustrating various stages of the document stacking cycle.

During the initial stage of the stacking state, power is applied to the motor 36, and an eccentric begins to rotate, thereby lifting the piston 28. As illustrated in FIG. 4, after a small amount of rotation has occurred, the piston 28 is in contact with the document 38, thereby causing the document to deform slightly. In this state, the flag 42 has cleared the optical switch 40.

Figure 8:
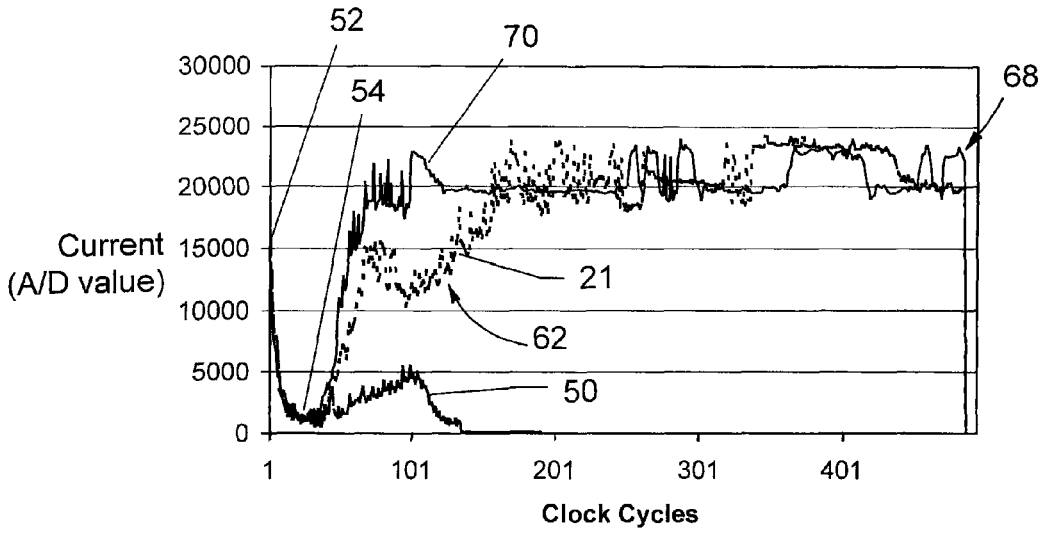
FIG. 8 is a graph showing examples of motor current curves.
Figure 9:
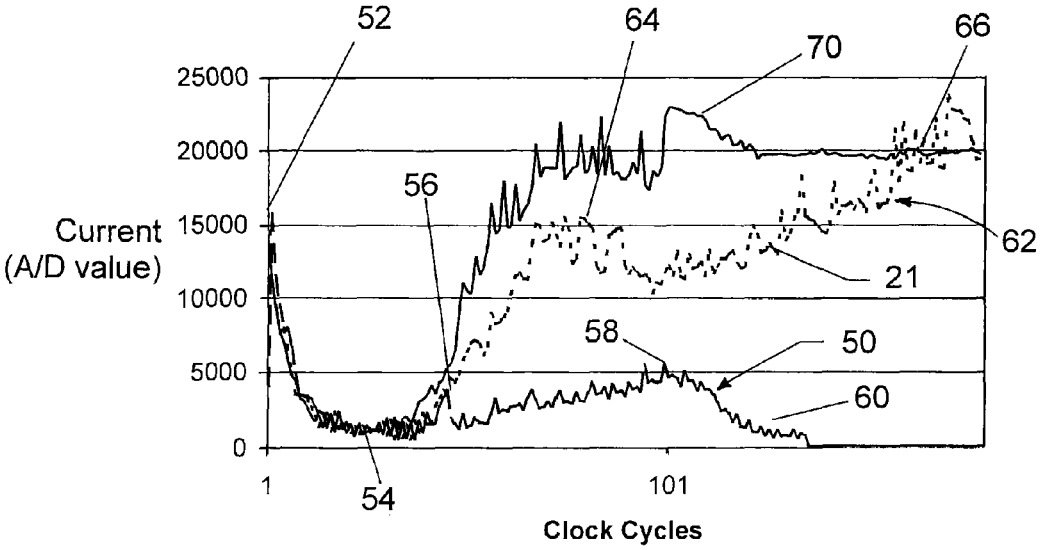
FIG. 9 is an enlarged version of a portion of the graph of FIG. 8.

A DC motor (such as motor 36) with a substantially fixed input voltage draws a current that is approximately proportional to the mechanical load placed upon it. For example, during the transition from the home position to the initial stacking stage of FIG. 3, the piston 28 encounters little mechanical resistance. An example of the profile of motor current is illustrated in FIGS. 8 and 9. The profile 50 indicates a brief inrush current 52 followed by a low trough 54 that reflects the light mechanical load.

Figure 5:
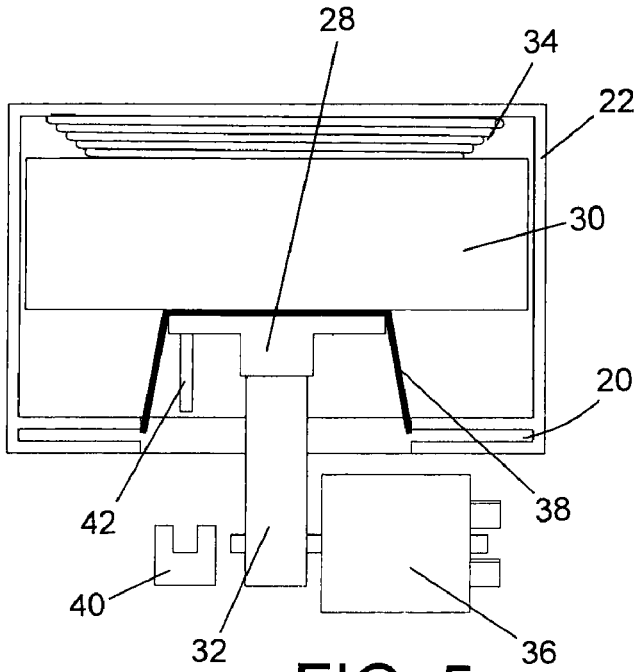

FIG. 5 illustrates the stacker 14 after the document 38 has been stripped from the pre-storage document channel 20. During this stage, the piston 28 encounters some resistance as a result of sliding friction, the document's resistance to bending and an increase in the force of the spring 34. As shown in FIGS. 8 and 9, the motor current increases to a peak 56 and then decreases briefly.

Figure 6:
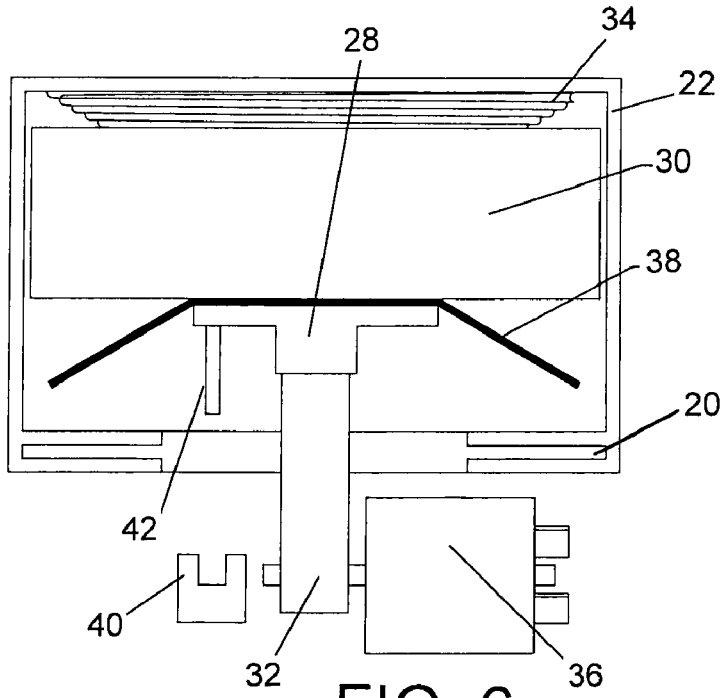

When the piston 28 is fully extended as shown in FIG. 6, the spring 34 exerts its maximum force, and the motor current reaches its maximum value as indicated by 58 in FIG. 9. The document 38 has completely passed from the pre-storage channel 20 and is located within the cassette 22.

Figure 7:
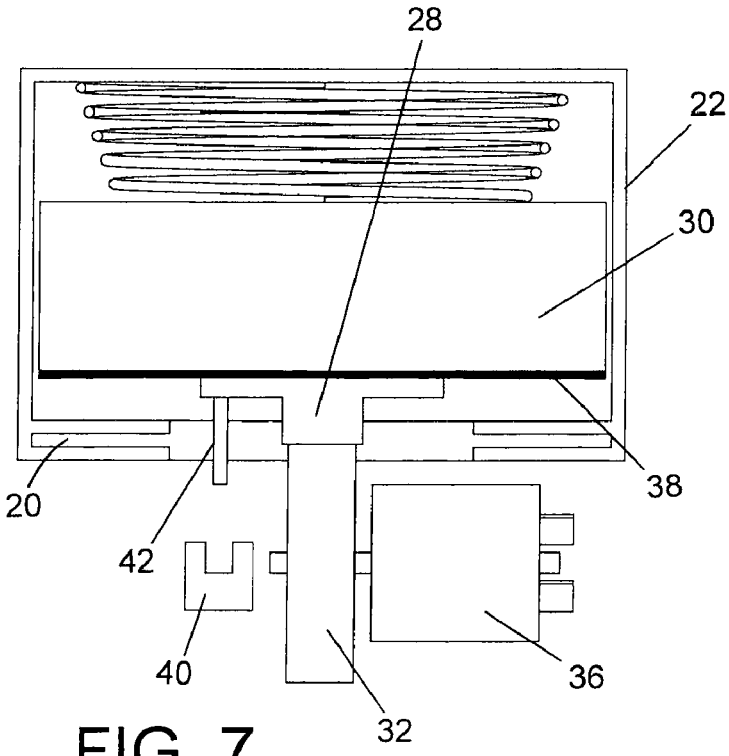

Next, the piston 28 reverses direction and travels in the opposite direction as illustrated by FIG. 7. During the return stroke, the force of the spring 34 helps push the piston 28 back toward its home position (FIGS. 2 and 3). Therefore, during the return stroke, the motor current is at a relatively low value as indicated by 60 in FIG. 9.

Under different circumstances, such as when the cassette 22 is substantially full. the expected values of motor current may vary significantly from the values indicated by curve 50. An example of the motor current profile when the cassette 22 is substantially full is indicated by curve 62 (FIGS. 8 and 9). In that case, the motor current during the home position and the initial stacking stage, corresponding to FIGS. 3 and 4, is similar to the motor current values of curve 50. In the subsequent stacking stages, however, the motor current values diverge. For example, the peak motor current value 64, which corresponds to the peak value 56 in curve 50, occurs at a higher value and at a later time. The later timing of the peak value 64 when the cassette 2 is full may be attributed to the fact that the stacker mechanism 14 slows down under the higher load. In the illustrated implementation, the full extension state of the piston 28, as shown in FIG. 6, is not attained when the cassette 22 is full (or almost full) to capacity. Instead, the motor current rises to a value 66, where it more or less remains for a period of time as a result of the motor 36 stalling. After an algorithm in the host controller 204 (FIG. 11) indicates that a maximum time has elapsed, the controller reverses the motor 36 so the stacker can return to its home position. In the example of FIG. 8, that occurs after about 500 clock cycles, identified by the reference numeral 68. The controller 204 then may report that the cassette is full and may place the banknote acceptor in an "out-of-service" mode until a replacement cassette is installed.

In some situations, the pre-storage document channel 20 may become obstructed by an object other than a genuine, acceptable document. Curve 70 (FIGS. 8 and 9) illustrate an example of the motor current profile when such an abnormal event occurs. In the illustrated example, the curve 70 corresponds to the motor current profile where the piston 28 becomes jammed in the position shown in FIG. 4. In that case, it is desirable to detect the abnormal condition and take appropriate action, such as returning the document 38 and canceling the transaction. Detecting an abnormal event may involve more than detecting stalling of the stacker motor 36 because, as discussed above, legitimate events also may cause the motor to stall, such as when the cassette 22 is full.

The controller 206 is adapted to determine whether an abnormal event has occurred based on signals sensed from the actuator (e.g., the motor 36) during a document stacking operation. Thus, the controller 206 is adapted to detect various abnormal events and to differentiate them from normal or legitimate events based, for example, on expected profiles of motor current.

For example, during the time window corresponding to the transition from the state shown in FIG. 4 to the state shown in FIG. 6, the current draw is higher for the curve 70 representing the abnormal event. Various algorithms may be used to differentiate between normal operations, such as those indicated by curves 50 and 62, and a fault condition, such as that indicated by curve 70.

In various implementations, one or more values indicative of the motor's actual operation may be compared to one or more reference values to determine whether the motor and, therefore, the stacker, is operating properly. For example, determining whether an abnormal event has occurred may include comparing an amount of time that has elapsed between specified sensed values to a predetermined amount of time. The amount of time that has elapsed from a specified point in the stacking operation to a peak value of actuator current may be identified, and determining whether an abnormal event has occurred may be based on the identified amount of time. Alternatively, the amount of time that has elapsed from a specified point in the stacking operation to a predetermined threshold value of actuator current may be identified, and determining whether an abnormal event has occurred may be based on the identified amount of time.

In yet other implementations, determining whether an abnormal event has occurred may include comparing an actual profile of the actuator current with an expected profile. In some cases, the actuator current may be integrated over a specified period of time during a document stacking operation to obtain an integrated value. Determining whether an abnormal event has occurred may be based on the integrated value, for example, by comparing the integrated value to a previously stored reference value. In some implementations, the reference value may be periodically adjusted based, for example, on previously sensed values of actuator current. The reference values and expected current profiles may be stored, for example, in memory 208 associated with the control system 204 (see FIG. 11).

Figure 10:
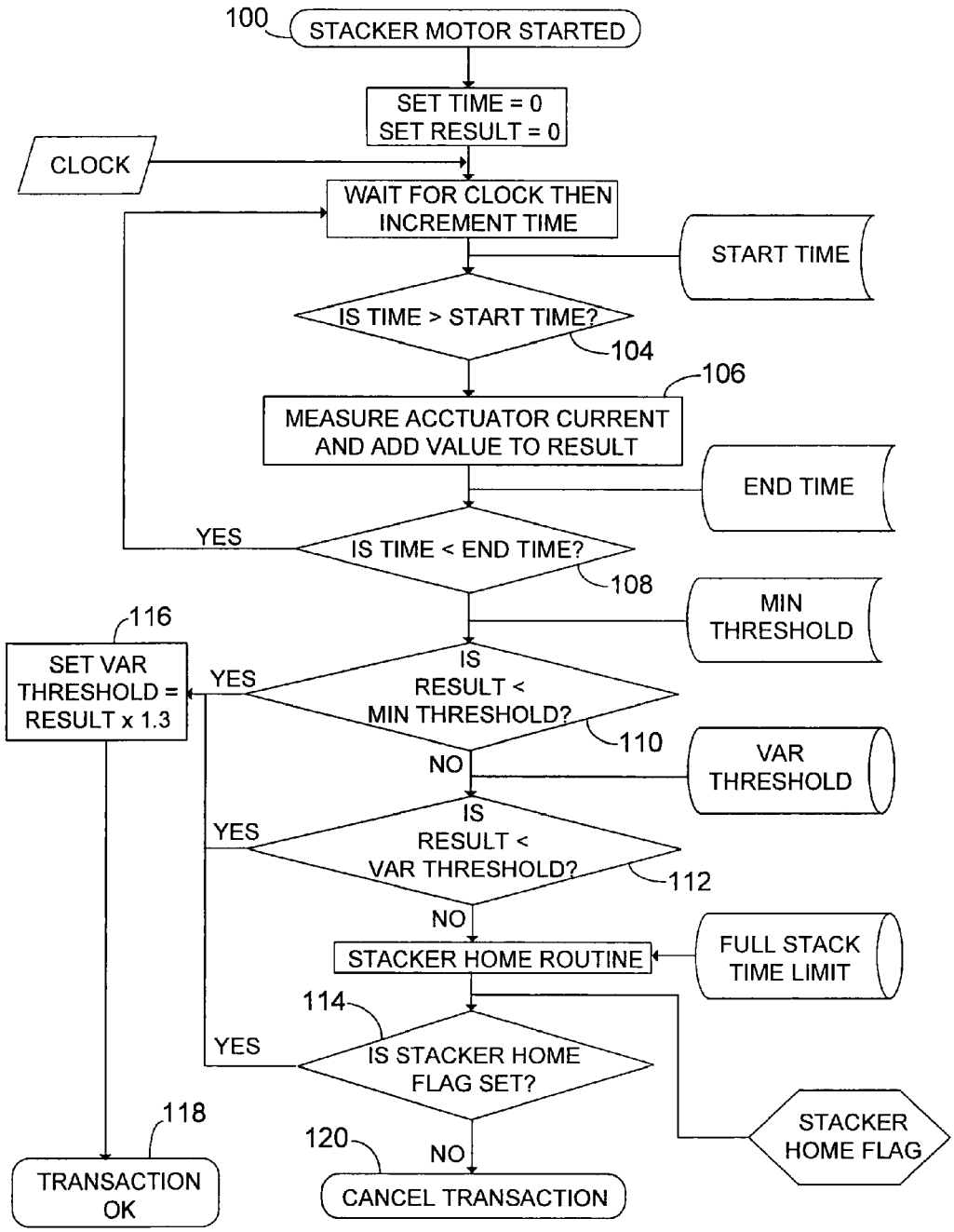
FIG. 10 is a flow chart of a method of detecting a fault during a stacking cycle according to one implementation of the invention.

In a particular implementation, when the stacker 14 enters the stacking state and power is applied to the motor 36, the controller 206 initiates the algorithm of FIG. 10. After power is applied to the stacker motor 36 (block 100), a software timer is started. A determination is made as to whether the elapsed time is greater than a start time, in other words, a determination is made as to whether a predetermined time delay has elapsed (block 104). If the predetermined time delay has elapsed, the motor current is measured, for example, using a series resistor and the measured value is sent to the controller 206 via the analog-to-digital converter 202. The resulting digital value (RESULT) may be stored in a register associated with the controller. At subsequent fixed time intervals, the motor current value is re-measured, and the new measured value is added to the previously-stored value (block 106). The register, therefore, stores an increasing value. After a predetermined time interval (see block 108), the current sampling is stopped, and a final value (RESULT) is stored in the register.

In the particular implementation of FIG. 10, the final stored value (RESULT) is compared to two previously determined values (see blocks 110 and 112): (1) a fixed baseline value (MIN THRESHOLD) determined, for example, by laboratory tests during product design; and (2) an adaptive baseline value (VAR THRESHOLD) based on a previous reference event. If the final stored value (RESULT) is less than the MIN THRESHOLD value, then the transaction is presumed to be valid (block 110). On the other hand, if the final stored value (RESULT) exceeds the VAR THRESHOLD value by more than a set amount, in this case 30%, the transaction is deemed suspect.

If the piston 28 successfully returns to its home position within a pre-determined time (see block 114), then the document is presumed to have been stacked in the cassette 22, and the customer is given credit for the transaction (block 118). On the other hand, if the piston 28 does not return to its home position within the predetermined time, the transaction is cancelled (block 120), and credit is not given to the customer. New adaptive baseline values (VAR THRESHOLD) may be determined following selected machine events (block 116). Such events may include, for example, successful stacking of a document, resetting of the machine, or installation of a new cassette.

Various aspects of the system may be implemented in hardware, software or a combination of hardware and software. Circuitry, including dedicated or general purpose machines, such as computer systems and processors, may be adapted to execute machine-readable instructions to implement the techniques described above. Computer-executable instructions for implementing the techniques can be stored, for example, as encoded information on a computer-readable medium such as a magnetic floppy disk, magnetic tape, or compact disc read only memory (CD-ROM). In one particular implementation, the computer-readable medium includes non-volatile electronic memory such a PROM, EPROM or FLASH. Algorithms also may be implemented, for example, through use of a programmable gate array.

The foregoing implementations, including the motor current profiles, are intended as examples only and are not intended to limit the scope of the invention.

The techniques may be employed in connection with stackers other than piston-type stackers, including, for example, stackers in which banknotes are wrapped around a drum or in which banknotes are rolled onto a stack. The techniques also may used with stackers using actuators other than DC motors, including, for example, actuators for stepper motors, AC motors and brushless motors. In some cases, signals other than current, including, for example, the phase lag may be used to measure the actuator load.

Other implementations are within the scope of the claims.

What is claimed is:

1. An apparatus comprising:

a document stacker including:

a cassette to store documents;

a piston operable to push a document from a pre-storage channel through an aperture into a document storage area in the cassette;

an actuator operable to control movement of the piston; and first circuitry operable to measure values of signals indicative of a load on the actuator during a document stacking operation; and second circuitry coupled to the actuator to control operation of the actuator and coupled to the first circuitry, wherein the second circuitry is operable to compare information about the measured values to a reference signal profile that comprises a plurality of different values and to determine whether an expected event has occurred or whether an unexpected event has occurred based on the comparison, wherein the apparatus operates differently depending on whether it is determined that an expected or unexpected event has occurred.

2. The apparatus of claim 1 wherein the second circuitry is operable to compare an amount of time that elapses between specified values of the measured signals to a predetermined amount of time and to determine whether an expected or unexpected event has occurred based on the comparison.

3. The apparatus of claim 1 wherein the second circuitry is operable to identify an amount of time that elapses from a specified point in the stacking operation to a peak value of actuator load and to determine whether an expected or unexpected event has occurred based on the identified amount of time.

4. The apparatus of claim 1 wherein the second circuitry is operable to identify an amount of time that elapses from a specified point in the stacking operation to a predetermined threshold value of actuator load, and to determine whether an expected or unexpected event has occurred based on the identified amount of time.

5. The apparatus of claim 1 wherein the second circuitry is operable to compare an actual profile of the actuator load with an expected profile and to determine whether an expected or unexpected event has occurred based on the comparison.

6. The apparatus of claim 1 wherein the second circuitry is operable to integrate the measured values of the signals corresponding to actuator load for a specified period of time during the document stacking operation to obtain an integrated value and to determine whether an expected or unexpected event has occurred based on the integrated value.

7. The apparatus of claim 1 wherein the measured signals are indicative of actuator load, and wherein the second circuitry is operable to adjust the reference signal profile based on previously measured values of actuator load.

8. The apparatus of claim 1 wherein the second circuitry is operable to use the measured signals to determine whether the cassette is full or the stacker is jammed.

9. The apparatus of claim 1 wherein the actuator includes a direct current motor.

10. The apparatus of claim 1 wherein the reference signal profile is a curve that represents values of actuator current during different phases of stacker operation.

11. The apparatus of claim 1 wherein the second circuitry is operable to compare an actual profile of actuator current to an expected profile of actuator current.

12. The apparatus of claim 1 wherein the second circuitry is operable to compare an actual curve of actuator current to an expected curve of actuator current.

13. The apparatus of claim 1 wherein the first circuitry is operable to measure values of signals indicative of a load on the actuator by sampling values of current corresponding to the actuator load at different times.

14. The apparatus of claim 1 wherein the reference signal profile represents current values indicative of the expected load on the actuator during different phases of stacker operation.

15. The apparatus of claim 1 wherein the second circuitry is operable to obtain information from the measured values about a transition from one state of the stacker operation to another state of the stacker operation and to compare the obtained information to an expected signal profile.

* * * * *